US009162787B2

(12) United States Patent
Hung

(10) Patent No.: US 9,162,787 B2
(45) Date of Patent: Oct. 20, 2015

(54) TANGENTIAL AIRSTREAM HEAT SHRINKING DEVICE OF PLASTIC FILM

(71) Applicant: Tzu-Chin Hung, New Taipei (TW)

(72) Inventor: Tzu-Chin Hung, New Taipei (TW)

( * ) Notice: Subject to any disclaimer, the term of this patent is extended or adjusted under 35 U.S.C. 154(b) by 428 days.

(21) Appl. No.: 13/705,812

(22) Filed: Dec. 5, 2012

(65) Prior Publication Data

US 2014/0151357 A1 Jun. 5, 2014

(51) Int. Cl.
*B65B 53/06* (2006.01)
*F24H 3/00* (2006.01)

(52) U.S. Cl.
CPC ..... *B65B 53/063* (2013.01); *B65B 53/066* (2013.01); *F24H 3/004* (2013.01)

(58) Field of Classification Search
None
See application file for complete search history.

(56) References Cited

U.S. PATENT DOCUMENTS

| | | | | | |
|---|---|---|---|---|---|
| 3,357,153 | A * | 12/1967 | Shaffer | 53/442 |
| 3,668,817 | A * | 6/1972 | Bell | 53/397 |
| 4,579,614 | A * | 4/1986 | Burmeister et al. | 156/85 |
| 5,050,368 | A * | 9/1991 | Noh | 53/442 |
| 6,158,199 | A * | 12/2000 | Emery et al. | 53/442 |
| 6,648,634 | B2 * | 11/2003 | Nava | 432/121 |
| 6,689,180 | B1 * | 2/2004 | Liao | 53/557 |
| 6,744,976 | B1 * | 6/2004 | Liao | 392/360 |
| 2005/0022469 | A1 * | 2/2005 | Fresnel | 53/399 |
| 2006/0266006 | A1 * | 11/2006 | VanderTuin et al. | 53/442 |
| 2014/0020343 | A1 * | 1/2014 | Liao | 53/557 |
| 2014/0020344 | A1 * | 1/2014 | Liao | 53/557 |

FOREIGN PATENT DOCUMENTS

| | | | |
|---|---|---|---|
| CN | 1473125 | A | 2/2004 |
| CN | 101641260 | A | 2/2010 |
| CN | 102050243 | A | 5/2011 |
| TW | 348070 | M | 6/2008 |

* cited by examiner

*Primary Examiner* — Joseph M Pelham
(74) *Attorney, Agent, or Firm* — Rosenberg, Klein & Lee

(57) ABSTRACT

A tangential airstream heat shrinking device of plastic film has a chassis, a heating chamber, air blowers, and high-temperature airstream ejectors. The heating chamber is mounted on the chassis and the heating channel is under the heating chamber. The air blowers are mounted to a bottom of the chassis. The high-temperature airstream ejectors are respectively fit into the mounting holes of the heating chamber. Heated air is discharged through a high-temperature airstream discharging opening of the air blade section under a respective high-temperature airstream ejector. A high-temperature airstream discharging opening is located inside the heating channel of the heating chamber. Each high-temperature airstream ejector can be rotationally adjusted so that the high-temperature airstreams are supplied along routes defined by different tangents at different angles along the circumference of a film-packaged article.

10 Claims, 9 Drawing Sheets

TANGENTIAL AIRSTREAM HEAT SHRINKING DEVICE OF PLASTIC FILM

BACKGROUND OF THE INVENTION

1. Field of the Invention

The present invention relates to a tangential airstream heat shrinking device of plastic film, and in particular to a device that is applicable to heat shrinking package and comprises a high-temperature airstream ejector that has a plurality of circumference tangential heat-shrinking routes of different angles for uniformly heating an external plastic film of the package.

2. The Related Arts

In a heat shrinking packaging process using a heat shrinking film, except a heat shrinking film wrapping operation, a primary packaging mechanism is the heating device for heat shrinking. The conventional heating device for heat shrinking is generally set up at one side, or both sides, or a top side of a packaged article. Thus, in heating the heat shrinking film wrapped externally around the packaged article, the routes along which high-temperature airstreams are ejected are only set at one side, both sides, or the top side of the packaged article. The manner of heating that is conventionally adopted is generally heating through high temperature airstream moving along linear routes. This generally results in inhomogeneous shrinking of the heat shrinking film wrapped externally around a packaged article. The outside appearance of the heat shrinking film package around the packaged article may be deformed or even broken. This deteriorates the quality of heat shrinking packaging and is thus a major issue to be addressed by the heat shrinking packaging device.

Related prior art references are known, such as Taiwan Utility Model M348070, which discloses a high-temperature airstream heating device, Chinese Patent Application No. 201010543690.7 (Publication No. CN102050243), which discloses a shrinking tunnel, Chinese Patent Application No. 200780052373 vehicle safeguard device 1 (Publication No. CN101641260), which discloses a shrinking oven that shrinks a shrinkable film over a packaged article or a packaged unit, and Chinese Patent Application No. 01818418 mold frame 9 (Publication No. CN1473125), which discloses a heat shrinking tunnel of packaging machine featuring high adaptability. All these references disclose conventional heating devices for heat shrinking, wherein high-temperature airstream heating devices are set up at two sides of a packaged article. Although heating can be conducted for packaged articles of different sizes, yet the manner of heating the heat shrinking film wrapped externally around the packaged article is still conducted in high-temperature airstream direct heating through linear routes and thus may still cause inhomogeneous heat shrinking of plastic film, eventually leading to problems and shortcomings, such as deformation of outside appearance formed after heat shrinking of the heat shrinking film, breaking, and being not able to improve quality of the packaged article.

SUMMARY OF THE INVENTION

For the conventional heat shrinking packaging device, since the heating airstreams are limited to one side or two sides or top side of a packaged article and heating is conducted through direct heating with high-temperature airstreams along linear routes, so that the heat shrinking package formed with heat shrinking film wrapped externally around the packaged article shows certain drawbacks of poor packaging quality that affects the outside appearance of the packaged article.

Thus, an object of the present invention is to provide a tangential airstream heat shrinking device of plastic film, which comprises:

a chassis;

at least a heating chamber, which is mounted on the chassis, a heating channel being arranged under the heating chamber to allow a film-packaged article to pass, the heating chamber having a top wall in which a plurality of mounting holes and a high-temperature air collection section are formed;

a plurality of air blowers, which is mounted to a bottom of the chassis, the air blowers each comprising an air inlet opening and an air outlet opening and functioning to pressurize air drawn in through the air inlet opening for discharging through the air outlet opening, the air inlet opening of each of the air blowers being connected through a collection pipe to the high-temperature air collection section of the heating chamber; and a plurality of high-temperature airstream ejectors, which is respectively fit into the mounting holes of the heating chamber and is rotatable, either clockwise or counterclockwise, along a circumferential track of the mounting hole, each of the high-temperature airstream ejectors having an upper end forming an intake opening, the intake opening being connected through a connection tube to the air outlet opening of the respective air blower in order to supply the air pressurized by the air blower to the airstream ejector for heating, the high-temperature airstream ejector having a lower end forming a high-temperature airstream discharging opening, the high-temperature airstream discharging openings being located at two sides of the heating channel of the heating chamber, the high-temperature airstream discharging opening of each of the high-temperature airstream ejectors having a high-temperature airstreams discharging route located on a different tangential route of a circumference of a film-packaged article at different angle.

In the tangential airstream heat shrinking device of plastic film described above, the chassis comprises an enclosure mounted thereon and the enclosure encloses the heating chamber.

In the tangential airstream heat shrinking device of plastic film described above, the mounting holes of the heating chamber are each provided with at least an indicator at a circumference thereof.

In the tangential airstream heat shrinking device of plastic film described above, the indicator is triangular.

In the tangential airstream heat shrinking device of plastic film described above, the high-temperature air collection section of the heating chamber forms a plurality of connection holes and the connection holes are respectively connected to the collection pipe of the air inlet opening of the air blower.

In the tangential airstream heat shrinking device of plastic film described above, the high-temperature airstream ejectors comprise:

a casing, which forms, in an outside wall thereof, at least an opening, the casing having a lower end being inserted into the respective mounting hole of the heating chamber;

an air intake tube, which is arranged inside the casing, the air intake tube having an upper end forming an intake opening, the intake opening being connected through the connection tube of the air outlet opening of the air blower, in order to supply air that is pressurized by the air blower into the air intake tube;

a heater, which is mounted outside the air intake tube to heat the air contained in the air intake tube, the heater having two power wires extending out through the opening of the casing for connection with an external power supply; and an air blade section, which is coupled under the casing, whereby the air blade section, after inserted into the mounting hole of the heating chamber to be located at two sides of the heating channel, the air blade section each forming a high-temperature airstream discharging opening, the air blade section being connected to the lower end of the air intake tube to allow the heated air contained in the air intake tube to be discharged through the airstream discharging opening.

In the tangential airstream heat shrinking device of plastic film described above, the casing has a lower end circumferential flange forming an angular indexing disk and the angular indexing disk has a surface forming a plurality of angle markings, each of which indicates a corresponding reference for identifying clockwise or counterclockwise rotational angle and position of the casing.

In the tangential airstream heat shrinking device of plastic film described above, the heater comprises an electrical heating filament.

In the tangential airstream heat shrinking device of plastic film described above, the air blade section forms therein an air discharge tube and the air discharge tube has an end connected to a lower end of the air intake tube.

In the tangential airstream heat shrinking device of plastic film described above, the air discharge tube comprises a stop bar arranged therein, whereby heated air that is fed into the air discharge tube is stopped by the stop bar to achieve an effect of pressurization and is then discharged through the air passage holes to be then ejected out through the high-temperature airstream discharging opening.

The efficacy of the tangential airstream heat shrinking device of plastic film according to the present invention is that rotary high-temperature airstream ejectors are provided and indexing achieved through an indicator of a heating chamber and angle marks formed on an angular indexing disk of each of the high-temperature ejectors allows high-temperature airstream discharging openings of the high-temperature airstream ejectors to set up high-temperature airstream discharge routes along tangents of an outer circumferences of a film-packaged article at different angles so that a heat shrinking film wrapped externally around the film-packaged article may show improved quality of packaging and ensure aesthetics of the outside appearance of the packaged article. Further, the heating chamber has a high-temperature air collection section that is connected to an air inlet opening of an air blower to allow the high-temperature air supplied from the high-temperature airstream ejectors to the heating chamber to be collected and re-used after heating the film-packaged article. This enables a significant saving of energy and improvement of performance of supplying of heated air from the high-temperature airstream ejectors.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
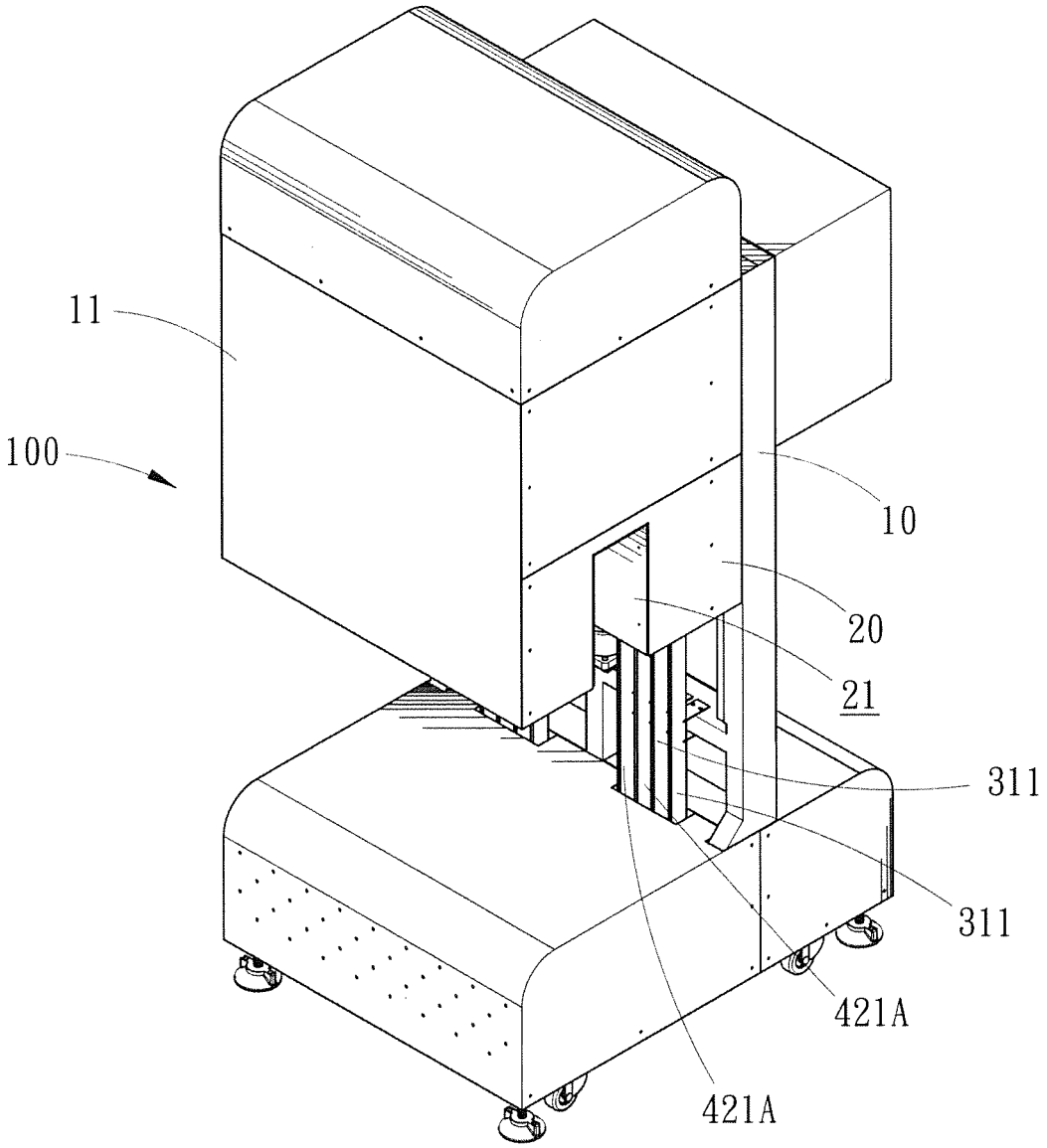
FIG. 1 is a perspective view showing a tangential airstream heat shrinking device of plastic film according to the present invention.
Figure 2:
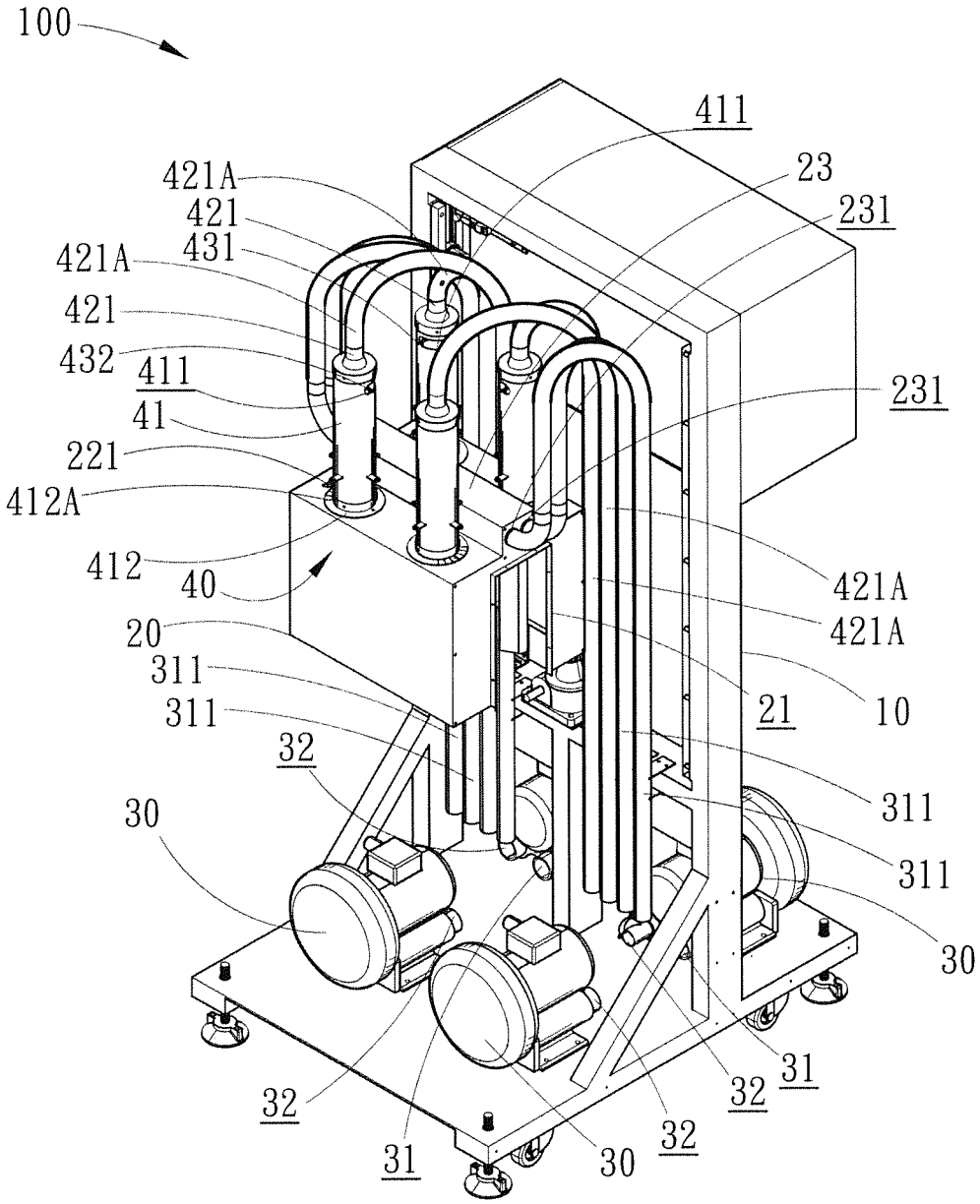
FIG. 2 is also a perspective view of the tangential airstream heat shrinking device of plastic film according to the present invention, but with the enclosure removed.
Figure 3:
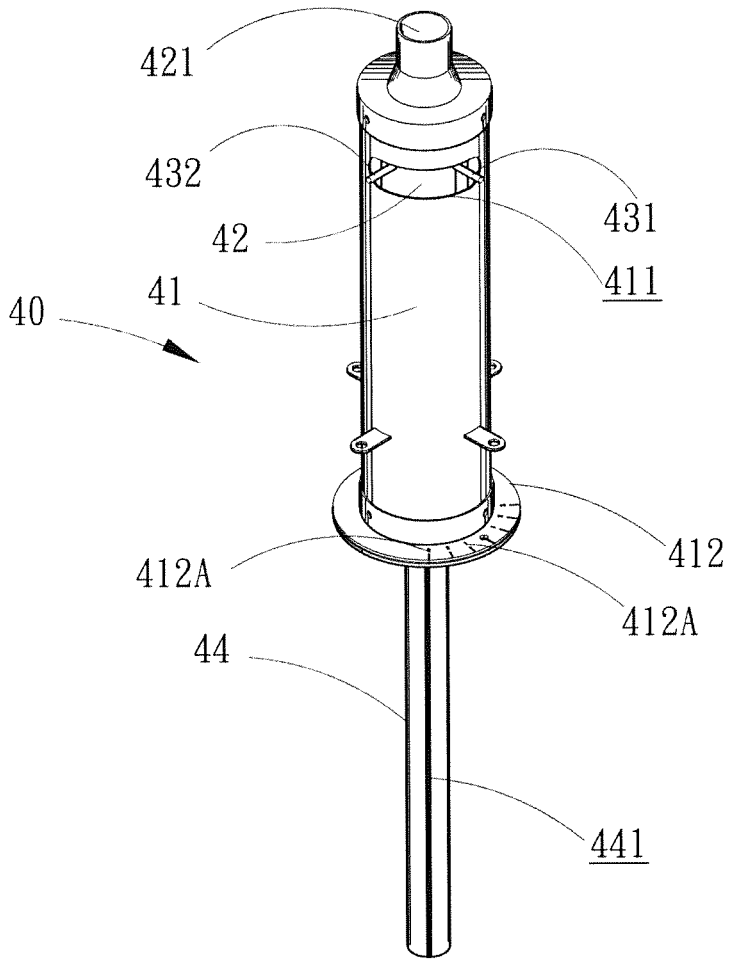
FIG. 3 is a perspective view showing a high-temperature airstream ejector of the tangential airstream heat shrinking device of plastic film according to the present invention.
Figure 4:
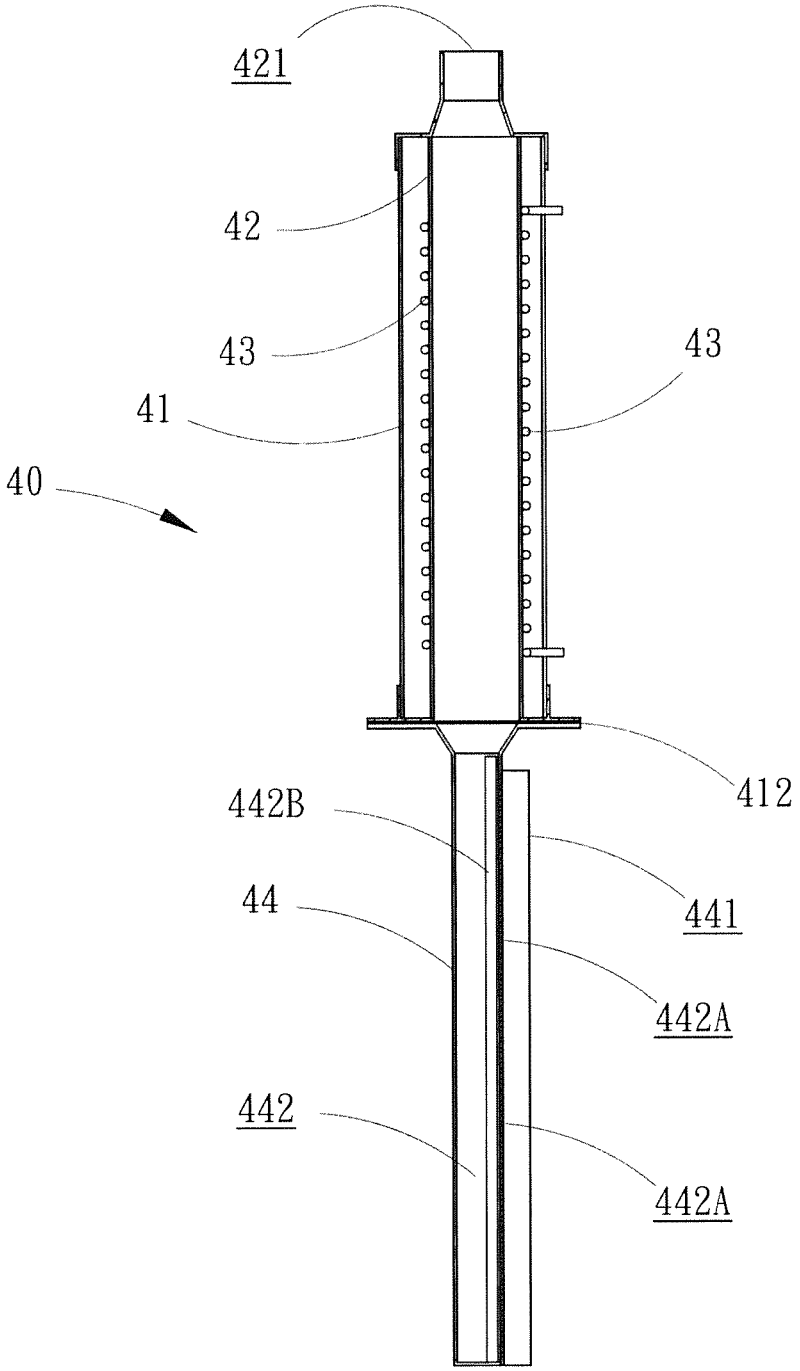
FIG. 4 is a cross-sectional view of the high-temperature airstream ejector of the tangential airstream heat shrinking device of plastic film according to the present invention.
Figure 5:
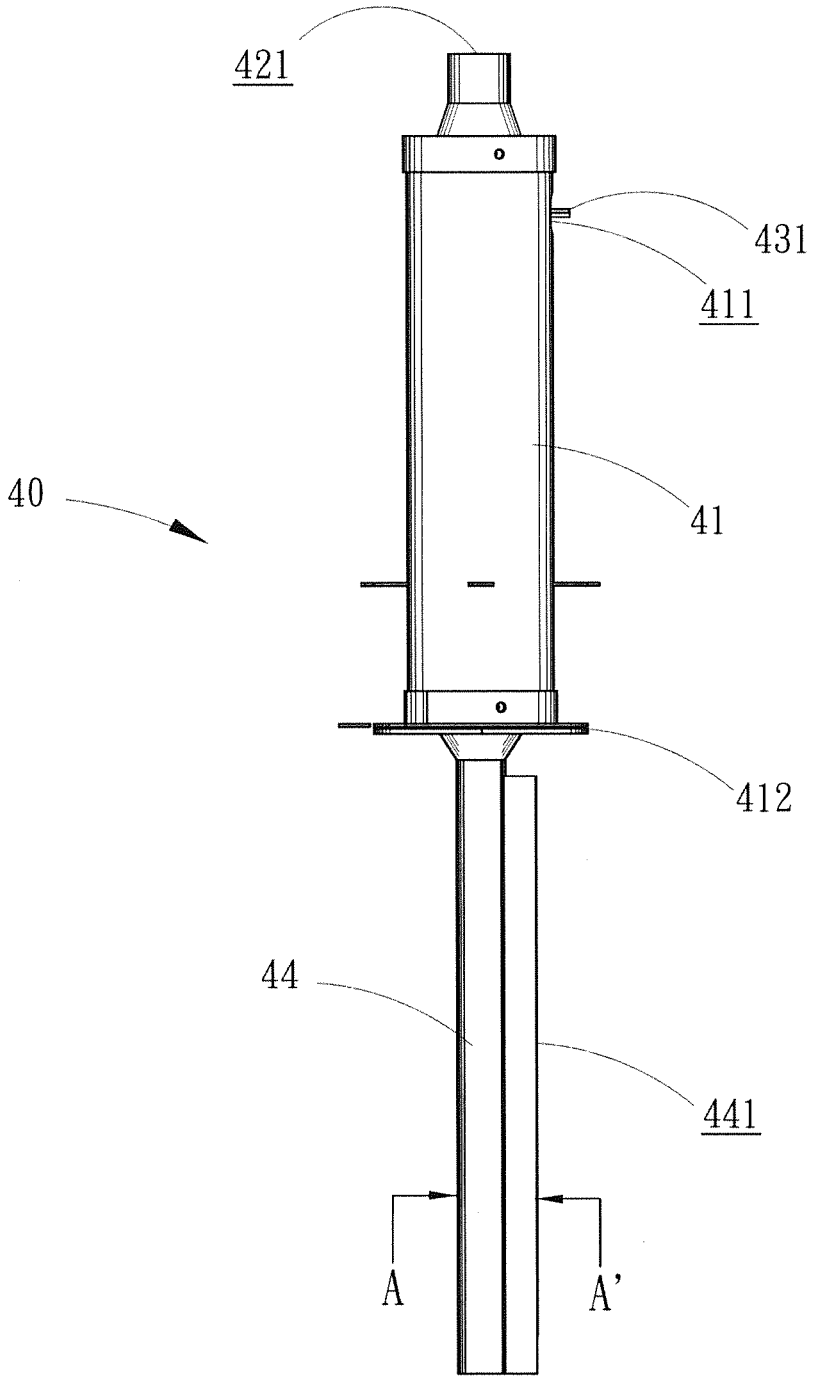
FIG. 5 is a side elevational view of the high-temperature airstream ejector of the tangential airstream heat shrinking device of plastic film according to the present invention.
Figure 6:
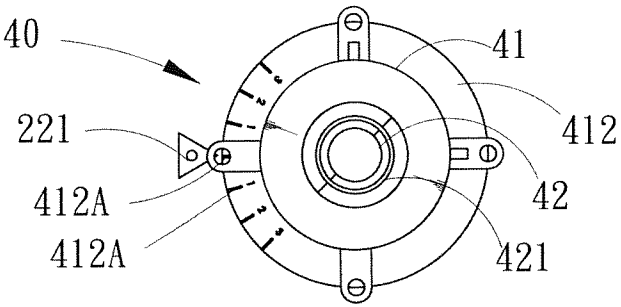
FIG. 6 is a top plan view showing spatial relationship between an indicator of a heating chamber and angle markings of an angular indexing disk of the high-temperature airstream ejector according to the present invention.
Figure 7:
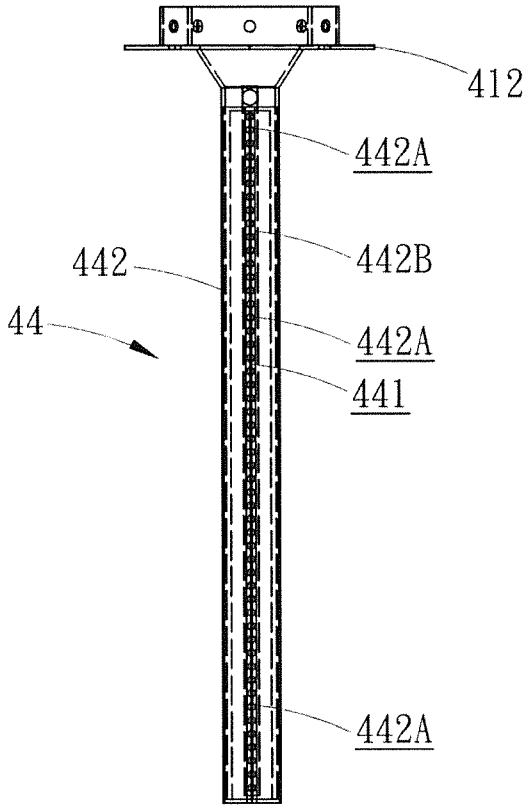
FIG. 7 is a front view showing an air blade section of the high-temperature airstream ejector shown in FIG. 3.
Figure 8:
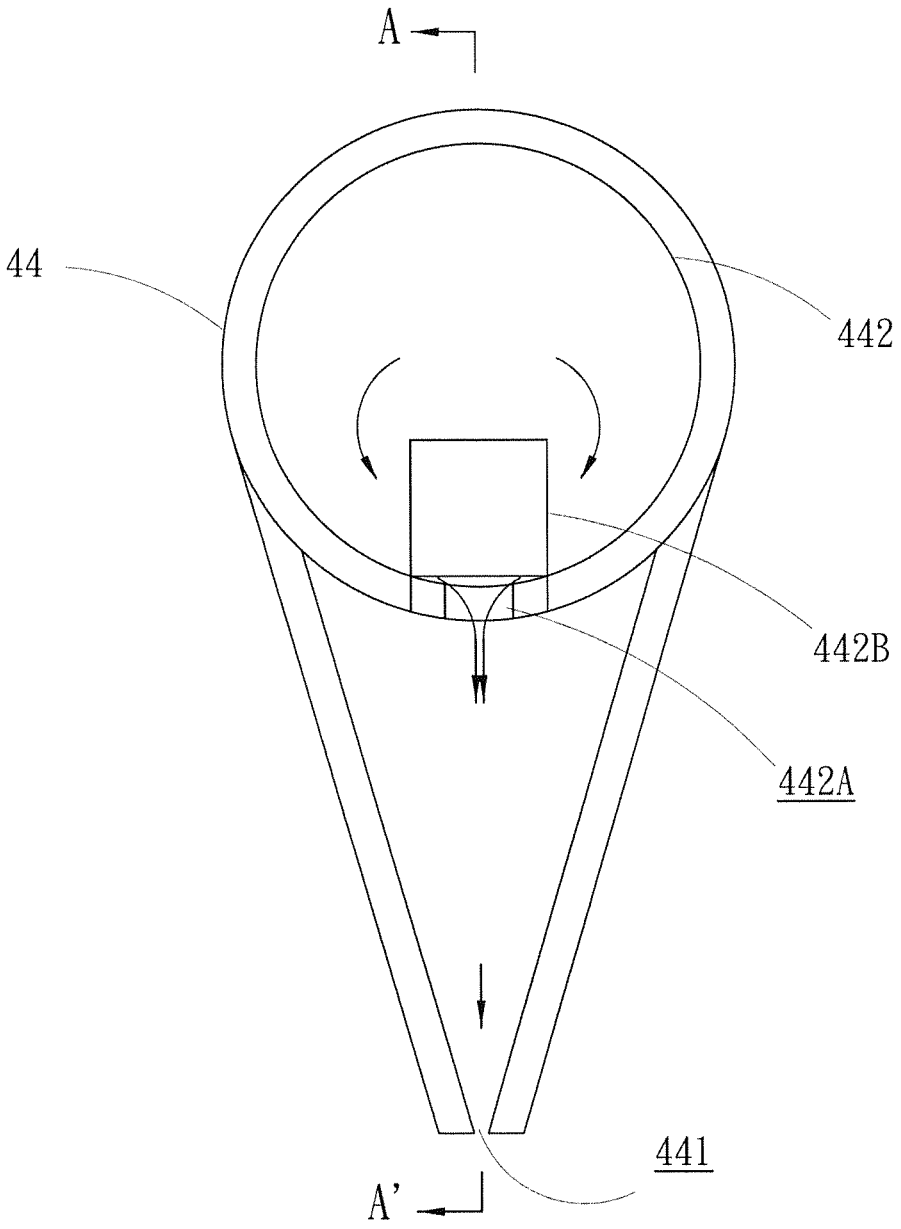
FIG. 8 is an enlarged sectional view taken along line A-A' of FIG. 5, showing high-temperature airstream discharged through a high-temperature airstream discharging opening of the air blade section.

With reference to the drawings and in particular to FIGS. 1 and 2, the present invention provides a tangential airstream heat shrinking device of plastic film, generally designated at 100, comprising a chassis 10. The chassis 10 comprises an enclosure 11 mounted thereon. At least a heating chamber 20 is mounted on the chassis 10 and is enclosed by the enclosure 11. A heating channel 21 is arranged under the heating chamber 20 to allow at least a film-packaged article 200 (see FIG. 9) to move therethrough. The heating chamber 20 has a top wall in which a plurality of mounting holes 22 (see FIG. 9) and a high-temperature air collection section 23 are formed. Each of the mounting holes 22 has a circumference to which at least an indicator 221 is mounted. The indicator 221 is not limited to any specific type and in the instant embodiment, a triangle is provided as an example. The high-temperature air collection section 23 forms a plurality of connection holes 231.

A plurality of air blowers 30 is mounted to a bottom of the chassis 10. The air blowers 30 each forms an air inlet opening 31 and an air outlet opening 32 and functions to pressurize air drawn in through the air inlet opening 31 for discharging through the air outlet opening 32. Further, the air inlet opening 31 of each of the air blowers 30 is connected through a collection pipe 311 to each of the connection holes 231 of the high-temperature air collection section 23 of the heating chamber 20.

Also referring to FIGS. 3, 4, 5, 6, 7, and 8, a plurality of high-temperature airstream ejectors 40 is respectively fit into the mounting holes 22 of the heating chamber 20 and is rotatable, either clockwise or counterclockwise, along a circumferential track of the mounting hole 22. The high-temperature airstream ejectors 40 are not limited to any specific type and each comprises, in an example given in the present invention, a casing 41, an air intake tube 42, a heater 43, and an air blade section 44, wherein the casing 41 of each of the high-temperature airstream ejectors 40 forms in an outside wall at least an opening 411. A lower end of the casing 41 is inserted into the respective mounting hole 22 of the heating chamber 20. The casing 41 has a lower end circumferential flange forming an angular indexing disk 412. The angular indexing disk 412 has a surface forming a plurality of angle markings 412A. Each of the angle markings 412A indicates a corresponding reference for identifying clockwise or counterclockwise rotational angle and position of the casing 41. Further, the angle markings 412 are used in combination with the indicator 221 of the respective mounting hole 22 of the heating chamber 20 (see FIG. 6), so that when the casing 41 is rotated along the circumferential track of the mounting hole 22 of the heating chamber 20, the rotational angle and position of the casing 41 can be identified through the angle marking 412A of the angular indexing disk 412 indicated by the indicator 221.

The air intake tube 42 is arranged inside the casing 41. The air intake tube 42 has an upper end forming an intake opening 421. The intake opening 421 is connected through a connection tube 421A (see FIG. 2) to the air outlet opening 32 of the respective air blower 30 in order to supply the air pressurized by the air blower 30 to the air intake tube 42. The heater 43 is mounted outside the air intake tube 42 to heat the air contained in the air intake tube 42. The heater 43 is not limited to any specific type and an electrical heating filament is taken as an example in the instant embodiment. The heater 43 has two power wires 431, 432 extending out through the opening 411 of the casing 41 for connection with an external power supply.

The air blade section 44 is coupled under the casing 41. The air blade sections 44 of the high-temperature airstream ejectors 40, after inserted into the mounting holes of the heating chamber 20, are located at two sides of the heating channel 21. The air blade section 44 each form a high-temperature airstream discharging opening 441 in a circumference thereof. The high-temperature airstream discharging opening 441 is not limited to any specific form and an elongate hole is taken as an example in the present invention. The air blade section 44 forms therein an air discharge tube 442. The air discharge tube 442 has an end connected to a lower end of the air intake tube 41 to allow the heated air contained in the air intake tube 41 to be fed into the air discharge tube 442. The air discharge tube 442 has a surface forming a plurality of air passage holes 442A. The air discharge tube 442 comprises a stop bar 442B (see FIG. 8) arranged therein, whereby heated air that is fed into the air discharge tube 442 is stopped by the stop bar 442B to achieve an effect of pressurization and is then discharged through the air passage holes 442A to be then ejected out through the high-temperature airstream discharging opening 441.

Figure 9:
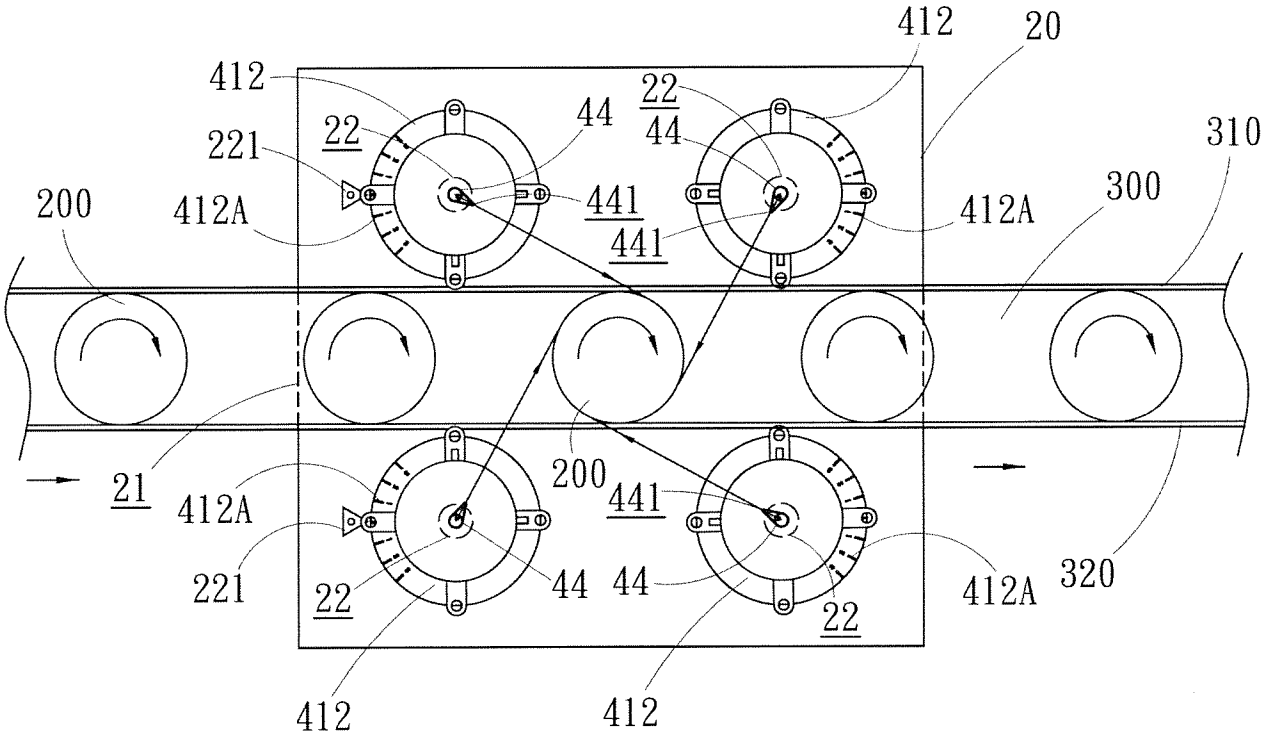
FIG. 9 is a top plan view showing a preferred exemplary application of the tangential airstream heat shrinking device of plastic film according to the present invention.

Referring to FIG. 9, an example of application of the tangential airstream heat shrinking device 100 is shown, wherein a conveyor device 300 extends through the heating channel 21 of the heating chamber 20. The conveyor device 300 carries a plurality of film-packaged articles 200 to convey film-packaged articles 200 forward one by one in a single direction. The conveyor device 300 has two sides along each of which a rotation belts 310 and 320, the rotation belts 310, 320 is arranged to engage an outer circumference of each of the film-packaged articles 200 so as to have the film-packaged article 200 clockwise rotated as being driven by the rotation belts 310,320. When the film-packaged article 200 that is in rotation passes through the heating channel 21 of the heating chamber 20, pressurized and high-temperature airstreams are ejected through the high-temperature airstream discharging openings 441 of the air blade sections 44 at the lower ends of the high-temperature airstream ejectors 40 so that the airstreams are supplied along tangential routes of the circumference of the film-packaged article 200 at different angles to have the plastic film wrapped around the surface of the film-packaged article 200 uniformly heated and shrinking by the airstreams supplied at different angle along the circumference thereby making the plastic film around the surface of the film-packaged article 200 uniformly heated and shrinking to enclose the film-packaged article 200.

For applications of heat shrinking packaging of film-packaged articles 200 of different diameters/sizes, it may be further possible to have the high-temperature airstream ejectors 40 each clockwise or counterclockwise orbiting along a circumferential track about the respective mounting hole 22 of the heating chamber 20. With the indication effected by the angle markings 412A of the angular indexing disk 412 of the casing 41 and the indicator 221 of the mounting hole 22 of the heating chamber 20, a user is allowed to accurately identify and correct the route and angle of the high-temperature airstream ejected through the high-temperature airstream discharging opening 441 of the air blade section 44 of each of the high-temperature airstream ejectors 40 to be precisely on the tangential routes of the circumference of the film-packaged article 200 at various angles.

The high-temperature airstreams supplied from the high-temperature airstream discharging openings 441 of the air blade sections 44 of the high-temperature airstream ejectors 40 travels through the surface of the film-packaged article 200 to make the plastic film heated and shrinking. Residual heat ascends and gathers in the high-temperature air collection section 23 above the heating chamber 20 (see FIG. 2) to be conducted through the collection pipes 311 back to the air blowers 30 for cyclically repeated use, enabling substantial reduction of power consumption and improvement of heating efficiency for applying the heaters 43 of the high-temperature airstream ejectors 40 to heat air contained in the air intake tubes 42.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A tangential airstream heat shrinking device of plastic film, comprising:

a chassis;

at least a heating chamber, which is mounted on the chassis, a heating channel being arranged under the heating chamber to allow a film-packaged article to pass, the heating chamber having a top wall in which a plurality of mounting holes and a high-temperature air collection section are formed;

a plurality of air blowers, which is mounted to a bottom of the chassis, the air blowers each comprising an air inlet opening and an air outlet opening and functioning to pressurize air drawn in through the air inlet opening for discharging through the air outlet opening, the air inlet opening of each of the air blowers being connected through a collection pipe to the high-temperature air collection section of the heating chamber; and a plurality of high-temperature airstream ejectors, wherein each of the airstream ejectors is respectively fit into each of the mounting holes of the heating chamber and each of the airstream ejectors is rotatable, either clockwise or counterclockwise, along a circumferential track of the mounting hole, each of the high-temperature airstream ejectors having an upper end forming an intake opening, the intake opening being connected through a connection tube to the air outlet opening of the respective air blower in order to supply the air pressurized by the air blower to the airstream ejector for heating, the high-temperature airstream ejector having a lower end forming a high-temperature airstream discharging opening, at least two of the high-temperature airstream discharging openings being located at opposite sides of the heating channel of the heating chamber, the high-temperature airstream discharging opening of each of the high-temperature airstream ejectors having a high-temperature airstreams discharging route located on a different tangential route of a circumference of a film-packaged article.

2. The tangential airstream heat shrinking device of plastic film as claimed in claim 1, wherein the chassis comprises an enclosure mounted thereon, the enclosure enclosing the heating chamber.

3. The tangential airstream heat shrinking device of plastic film as claimed in claim 1, wherein the mounting holes of the heating chamber are each provided with at least an indicator at a circumference thereof.

4. The tangential airstream heat shrinking device of plastic film as claimed in claim 3, wherein the indicator is triangular.

5. The tangential airstream heat shrinking device of plastic film as claimed in claim 1, wherein the high-temperature air collection section of the heating chamber forms a plurality of connection holes, the connection holes being respectively connected to the collection pipe of the air inlet opening of the air blower.

6. The tangential airstream heat shrinking device of plastic film as claimed in claim 1, wherein the high-temperature airstream ejectors comprise:

a casing, which forms, in an outside wall thereof, at least an opening, the casing having a lower end being inserted into the respective mounting hole of the heating chamber;

an air intake tube, which is arranged inside the casing, the air intake tube having an upper end forming an intake opening, the intake opening being connected through the connection tube of the air outlet opening of the air blower, in order to supply air that is pressurized by the air blower into the air intake tube;

a heater, which is mounted outside the air intake tube to heat the air contained in the air intake tube, the heater having two power wires extending out through the opening of the casing for connection with an external power supply; and an air blade section, which is coupled under the casing, whereby the air blade section, after inserted into the mounting hole of the heating chamber to be located at two sides of the heating channel, the air blade section each forming a high-temperature airstream discharging opening, the air blade section being connected to the lower end of the air intake tube to allow the heated air contained in the air intake tube to be discharged through the airstream discharging opening.

7. The tangential airstream heat shrinking device of plastic film as claimed in claim 6, wherein the casing has a lower end circumferential flange forming an angular indexing disk, the angular indexing disk having a surface forming a plurality of angle markings, each of which indicates a corresponding reference for identifying clockwise or counterclockwise rotational angle and position of the casing.

8. The tangential airstream heat shrinking device of plastic film as claimed in claim 6, wherein the heater comprises an electrical heating filament.

9. The tangential airstream heat shrinking device of plastic film as claimed in claim 6, wherein the air blade section forms therein an air discharge tube, the air discharge tube having an end connected to a lower end of the air intake tube.

10. The tangential airstream heat shrinking device of plastic film as claimed in claim 9, wherein the air discharge tube comprises a stop bar arranged therein.

* * * * *